United States Patent [19]

Crickmer

[11] 3,991,837

[45] Nov. 16, 1976

[54] BUOYANT COUNTERBALANCING FOR DRILL STRING

[75] Inventor: Charles D. Crickmer, Houston, Tex.

[73] Assignee: Joy Manufacturing Company, Pittsburgh, Pa.

[22] Filed: May 18, 1973

[21] Appl. No.: 361,593

[52] U.S. Cl. ..... 175/27; 175/5; 254/172

[51] Int. Cl.[2] ..... E21B 19/08

[58] Field of Search ..... 175/5, 27, 7; 166/.5, 166/.6; 285/270, 261; 254/172, 173

[56] References Cited

UNITED STATES PATENTS

| | | | |
|---|---|---|---|
| 1,817,467 | 8/1931 | Thompson | 175/203 X |
| 2,292,268 | 8/1942 | Gibbons et al. | 175/61 X |
| 2,786,532 | 3/1957 | Creighton | 166/73 |
| 2,847,188 | 8/1948 | Wiltse | 175/195 X |
| 3,158,206 | 11/1964 | Kammerer | 175/27 X |
| 3,177,954 | 4/1965 | Rand | 175/7 |
| 3,421,581 | 1/1969 | Van Geijn | 175/5 X |
| 3,454,288 | 7/1969 | Mancusi | 285/261 X |
| 3,556,231 | 1/1971 | Henderson | 175/27 X |
| 3,653,635 | 4/1972 | Bates et al. | 175/5 |
| 3,739,844 | 6/1973 | Peterman et al. | 175/27 |
| 3,917,006 | 11/1975 | Kellner | 175/5 |
| R27,261 | 12/1971 | Bromell et al. | 175/7 |

*Primary Examiner*—Ernest R. Purser
*Assistant Examiner*—Richard E. Favreau

[57] ABSTRACT

A fluid actuated counterbalancing apparatus and method for maintaining substantially constant height of the upper end of a string of members suspended from a vessel floating on a body of water wherein such position is controlled by a buoyant element floating in the water in a vertical open ended tube extending downwardly into the body of water to a virtually stable water level.

13 Claims, 13 Drawing Figures

BUOYANT COUNTERBALANCING FOR DRILL STRING

In the field of underwater drilling, particularly from vessels floating in a body of water under which the drilling is taking place, the undesirable effect of up and down wave motion of the vessel upon an elongated string of members suspended from a floating vessel such as drill pipe, well casing, production tubing or the like, hereinafter referred to as a drill string but not limited thereto, has long been recognized. Many attempts have been made to design compensators for this up and down vessel motion by reference to some stationary point usually an anchor point at the bottom of the body of water. Such attempts have been successful in some cases but have suffered from various draw backs particularly the draw back of needing an anchor line extending to the bottom of the body of water. When drilling is being accomplished under depth of water greater than a few hundred feet an anchored object on or near the surface of the water is not very steady for example, line stretch introduces variables. Also many of the designs were very complicated mechanical structures or hydraulic circuits susceptible of malfunction and deterioration.

The counterbalancer of this invention uses a buoyant element floating in an open ended tube extending downwardly into the body of water to a point below significant surface wave action and according to computations and measurements deep enough that pressure changes due to surface wave action are relatively small so that the body of water in the tube remains substantially stationary with respect to the bottom of the body of water or ocean floor and a buoyant element in the water within the tube furnishes a reference point of substantially constant height with respect to the surface of the earth and consequently with respect to the bottom of the bore being developed by the drill string.

In the structure of the present invention the buoyant element is a float having enough buoyancy to provide a force large enough to counterbalance the weight of the drill string and with the constant height of the buoyant element maintain a constant height of the upper end of the drill string even though the vessel on which the drill string supporting derrick and the vertical tube are mounted is moving up and down due to wave action. Constant tension on the drill string is accomplished by stabilizing the vertical distance of the string support (i.e. hook) from the bottom of the body of water or of the well bore. Such constant positioning is the main object of the present invention.

Thus, the principles of this invention provide for maintaining constant positioning of a drill string supported from a vessel floating in disturbed water.

These and other advantages of the buoyant counterbalancer of this invention will be more readily apparent upon consideration of the following description and drawings in which.

Figure 1:
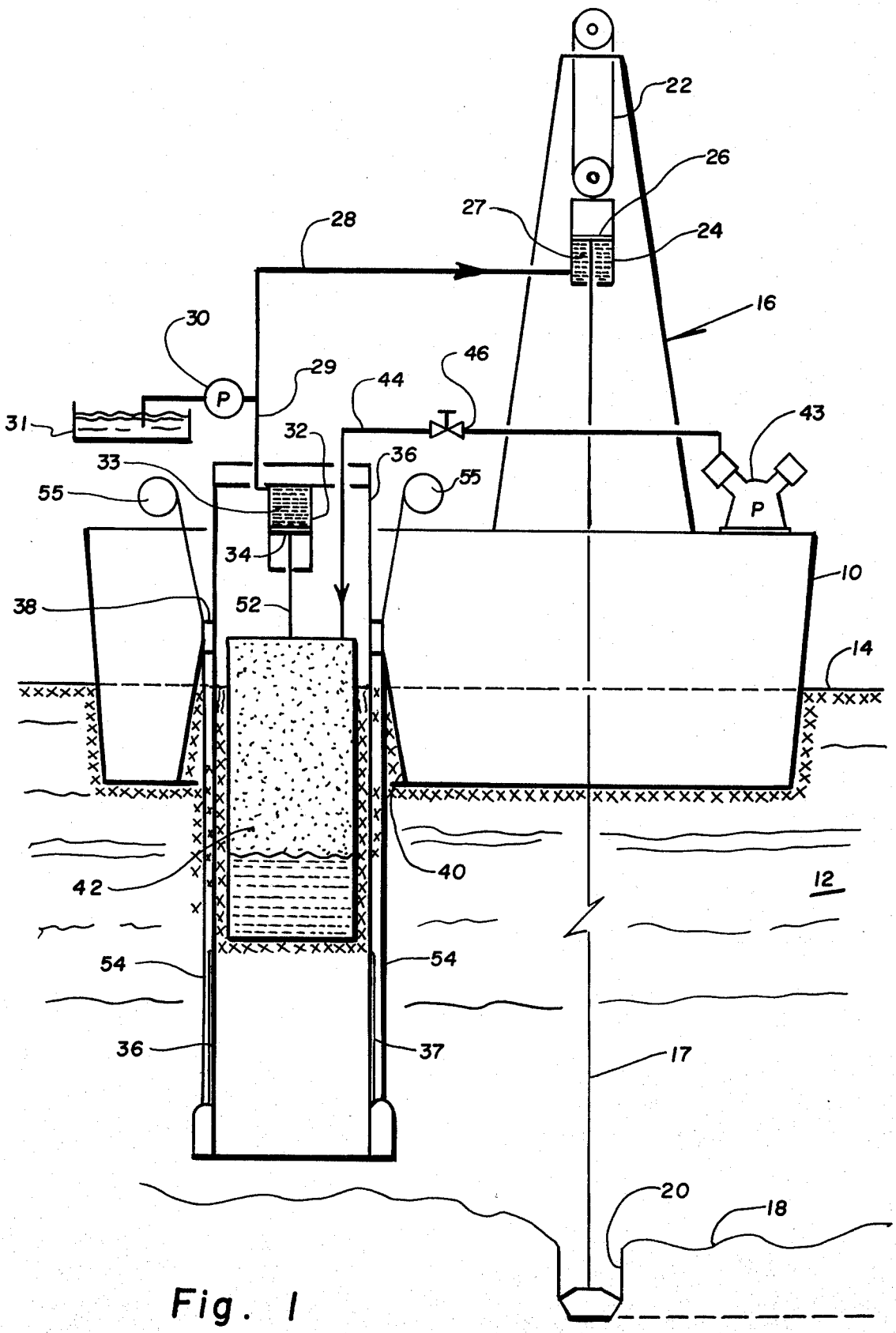
FIG. 1 is a schematic representation of the counterbalancer of this invention incorporated in a floating drilling vessel in a quiescent body of water.

In FIG. 1 there is schematically represented a vessel or drilling platform 10 floating in a body of water 12 indicating as having a quiescent water level by horizontal line 14.

Mounted upon the vessel 10 is a drilling rig generally indicated at 16 from which is suspended a drill string 17 of the type used for rotary drilling in a manner well known in the art. The body of water is represented as having a bottom 18 through which the drilling is taking place with the formation of a well bore such as that shown at 20 with drilling tools (not shown) engaged with the bottom of the well bore 20.

A cable and sheave suspension of a hook type well known in the art is indicated at 22 as supporting a fluid actuating means such as a single acting hydraulic cylinder 24 having therein a piston 26 resting upon confined liquid 27 within the cylinder 24 by virtue of pressure applied to the liquid 27 as willl hereinafter be made clear. The portion of the cylinder 24 below the piston 26 communicates by way of lines 28 and 29 connected to a pump 30, with another fluid actuated or actuating means such as a second single acting hydraulic cylinder 32 having a liquid containing portion 33 above a hydraulic piston 34 received within the cylinder 32 in fluid tight slidable relationship therewith in a manner well known in the art of hydraulic force application. The cylinder 32 is mounted in the upper reach portion of a vertically extending open ended telescoping conduit 36, gimbal mounted as at 38 within an opening 40 extending downwardly through a vessel 10 with the opening 40 tapering outwardly and downwardly from the gimbal mounting 38 to allow for swinging of the conduit 36 in its gimbal mounting to compensate for angular pitch and roll of the vessel 10. Within the conduit 36 there is shown an elongated vertically disposed buoyant element or float body 42 of hollow cylindrical shape and of a diameter small enough to have the lateral surface thereof radially spaced inwardly from the inner diameter of the conduit 36 to allow free passage of water therebetween. The float 42 has air and water therewithin but having suitable openings in the float 42 the amount of water within the float 42 can be adjusted as by a compressor 43 communicating with the upper portion of the float 42 by a compressed air conducting line 44 under control of a valve 46 in line 44 which valve 46 is adapted to allow flow of air from the compressor 43 to the float 42 or, upon being manually or automatically adjusted, the valve 46 can allow air to escape from the float 42 in a well known manner to provide for having the float mainly filled with water for light hook loads.

It is, of course, possible to adjust the buoyancy of float 42 by any method of varying the amount of liquid therein, e.g. pumping water into and out of a float having a water tight bottom and sides.

Figure 3:
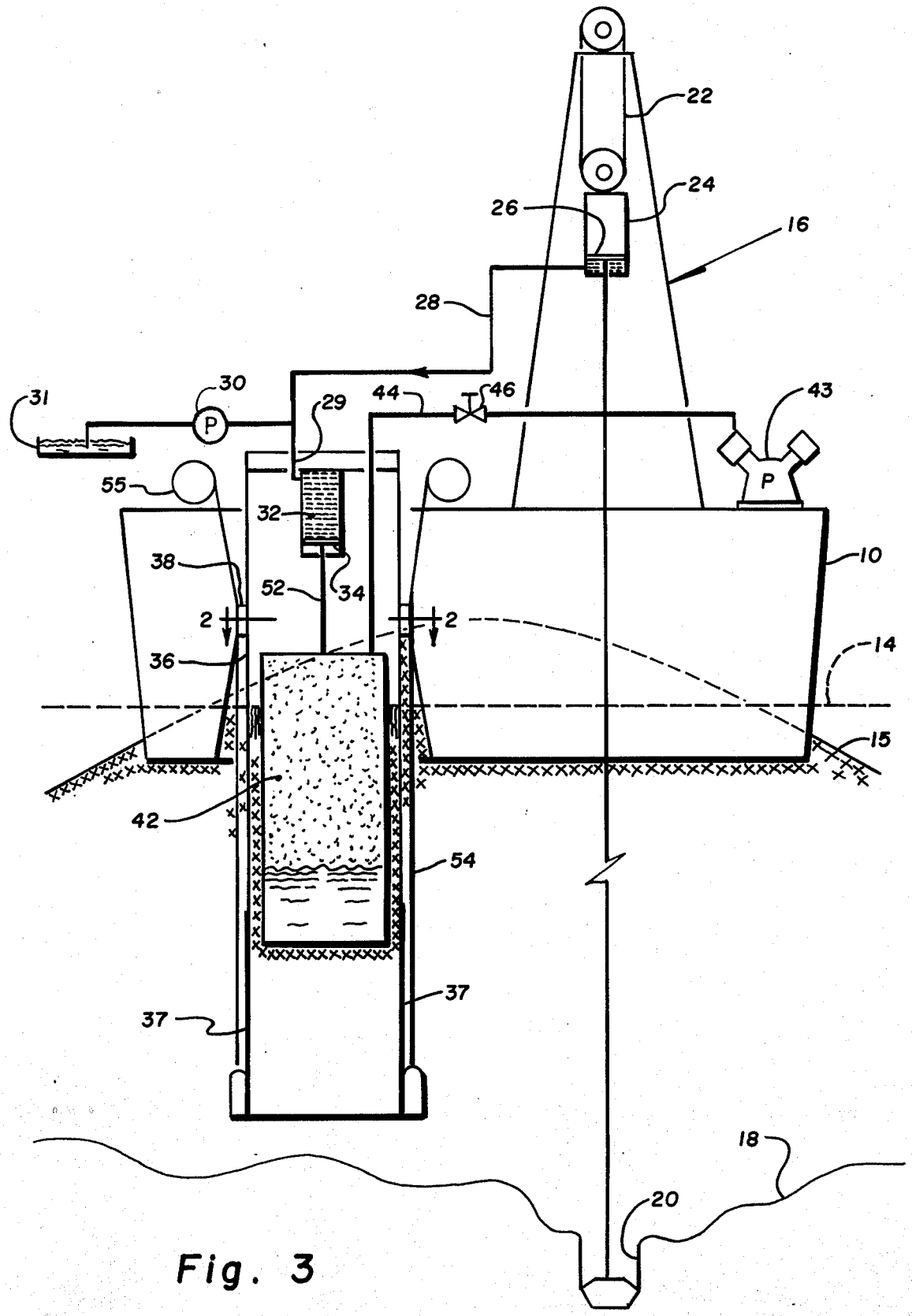
FIG. 3 is a schematic representation similar to FIG. 1 but showing the apparatus as it would appear when reacting to upward motion of the vessel due to wave action near the crest of the wave.
Figure 4:
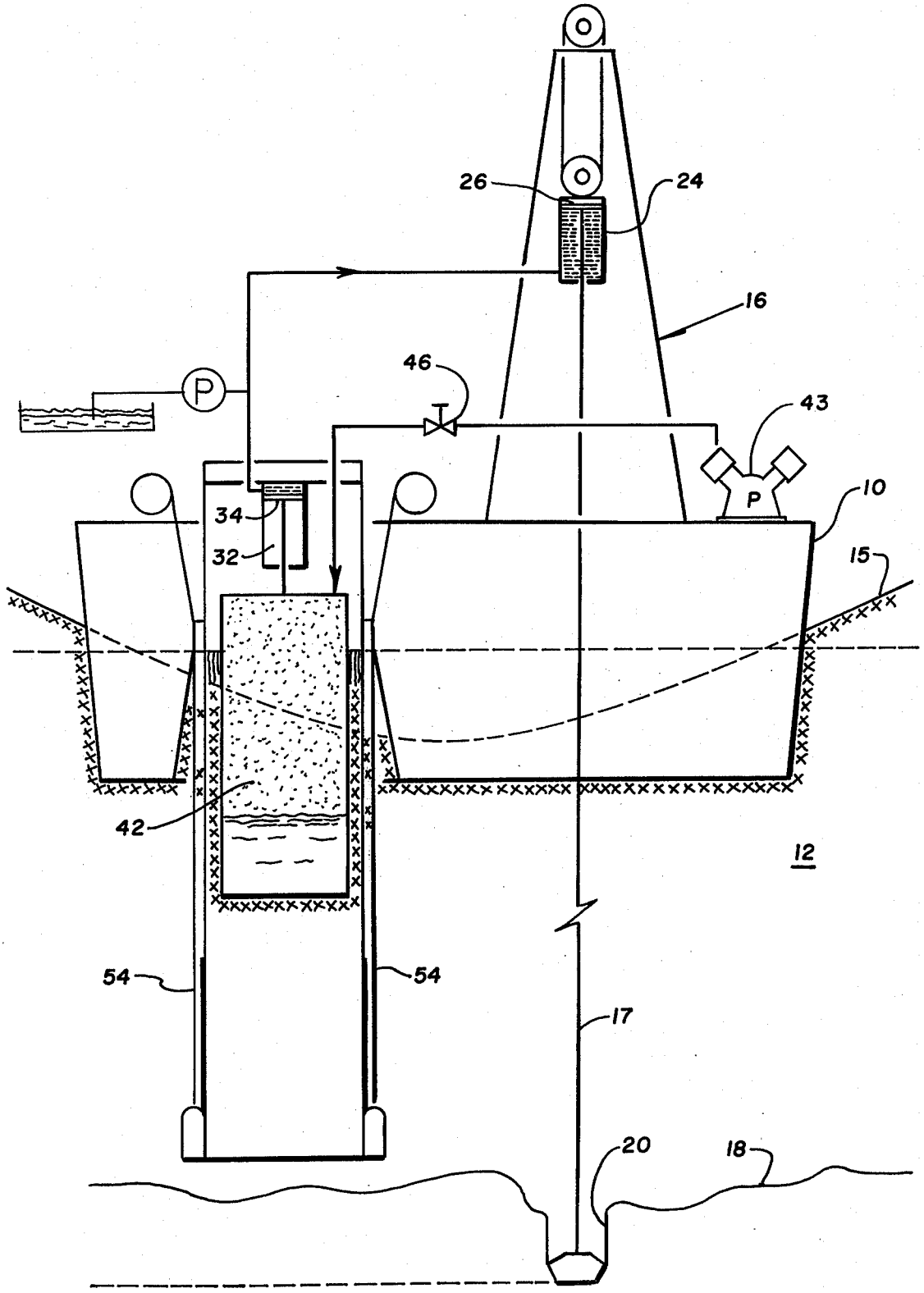
FIG. 4 is another view similar to FIG. 1 showing the relationship of the various parts of the device when traversing the trough of the wave.

It is to be noted that either or both of the cylinders 24 and 32 could be multiple cylinders serving the same purpose as the single cylinders shown schematically in FIGS. 1, 3 and 4. With a number of floats, conduits and cylinders equally distributed about the vessel's center of gravity and equally spaced therefrom, the effects of vessel pitch and roll can be cancelled out to improve the stabilizing action of the float members of this invention. Multiple cylinders could be smaller than single ones for a further advantage.

Figure 2:
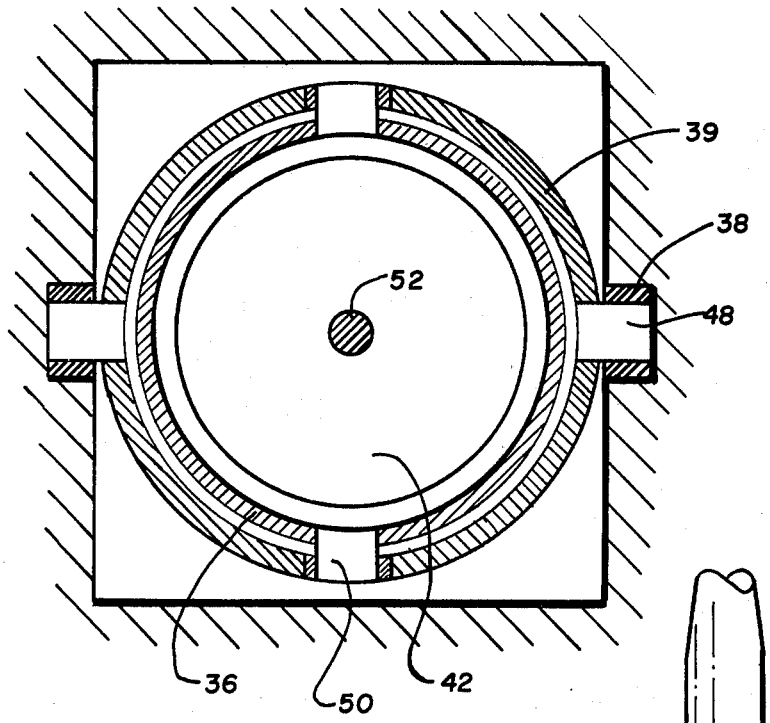
FIG. 2 is a sectional view of gimbal ring mountings taken substantially on line 2—2 of FIG. 3 looking in the direction indicated by the arrows.

The gimbal mounting of the conduit 36 is more readily understood by inspection of FIG. 2 wherein it is seen that the gimbal mounting 38 comprises a gimbal ring 39 pivotally supported within the gimbal mounting 38 by a pair of diametrically opposite gimbal pins 48 rotatably received within the gimbal mounting 38 and secured to opposite sides of the gimbal ring 39. Within the gimbal ring 39 the conduit 36 is pivotally supported by a pair of diametrically opposite gimbal pins 50 rotatably received in the gimbal ring 39 and secured to the conduit 36 to complete a universally pivotable gimbal mounting of a type well known in the art.

Secured to the top center of the float 42 (see FIG. 1) is an elongated rigid, upwardly extending piston rod 52 connected to the piston 34 so that forces on the float 42 are transferred directly through the piston rod 52 to the piston 34 and therefrom to the liquid in the portion 33 of the cylinder 32.

The conduit 36 is shown as having an extensible lower portion 37 held in partially retracted position in FIGS. 1, 3 and 4 by cables 54 controlled by winches 55 mounted on the deck of the vessel in a well known manner. The conduit 36 would be held in a retracted condition such as that shown at the left in FIG. 7 during transporting of the drilling rig 16 by moving the vessel 10 along normal waterways and into the body of water where drilling is to take place. Upon arrival at the scene of the drilling activity the tension on cables 54 would be released and the bottom portion 37 of the conduit allowed to extend to the desired depth as hereinafter set forth to provide the calm water surface within the conduit 36 necessary for the proper operation of this apparatus.

Calculations using the parameters involved in the action of water in a confined body and the relationship of the water surface within a vertical conduit under the influence of wave motion outside the conduit in the same body of water, as well as extensive model testing yield information that a conduit of sufficient length extending open endedly down into the water would provide an inner water surface isolated from the general water surface and of nearly constant level with reference to the bottom of the body of water. The vertical motion response of the water column in the conduit is known to be similar to the heave response of a slender vertical spar buoy. This is a lightly damped resonant one degree of freedom system with a natural frequency given by $W_n = \sqrt{g/L}$, where L is the length of the conduit or spar buoy. For natural water column frequencies less than half the wave frequency, the float motion within the conduit is substantially less than the wave motion at the surface. Correspondingly, reduced natural frequencies due to greater conduit length will further detune the system and accommodate greater wave action having lower frequency.

The volume of the float 42 is determined by the amount of force necessary on the piston rod 52 in order to counterbalance the weight of the drill string 17 by pressure of the liquid at 33 and 27. Applying various considerations of vessel configuration, reasonable pressures, amounts of liquid to be transferred, and the like, it has been found that a float of a diameter between 10 and 20 feet and of a vertical height in the range of 30 to 60 feet produces reasonable values of the parameters involved.

The necessary air pressure within the float 42 is of course, determined by the desired difference in the water level between the interior and exterior of the float which in turn determines how much lift force there is on the float and would vary for different weights of drill string. The pressure however figures out to be in the range of 15 to 40 pounds per square inch gage for the air within the float 42 and is easily provided by normal supply of compressed air on the drill rig under control of the valve 46.

It is to be noted that there is a hydraulic pump 30 having a source of hydraulic liquid 31, which communicates with lines 28 and 29 so that controlled operation of the pump 30 can be used to adjust the amount of liquid within the hydraulic system represented by the portions 27, 33 and the lines 28 and 29 while maintaining the pressure determined by the pistons 34 and 26.

The pressure in the cylinder 24 under the piston 26 is of course determined by the size of the piston and the weight of the drill string 17 and that amount of pressure is supplied by the piston 34 acting on the liquid in the portion 33 under force from the piston rod 52 being acted upon by the forces of flotation of the float 42. Adjustment of the amount of water in the float 42 will provide the correct amount of pressure within the portion 33 to counterbalance the weight of the drill string 17 when work operations are ready to begin. At such time it would be most likely desirable to adjust the amount of liquid in the hydraulic circuit so that at level water as shown in FIG. 1 there would be approximately equal amounts of liquid in the cylinders 24 and 32.

In FIG. 3 there is schematically represented a wave 15 which is lifting the vessel 10 away from the bottom 18 so that with no provision made for counterbalancing or heave compensation the drill might be lifted off the bottom or at any rate the drilling force would be much reduced.

As the vessel 10 rises on the wave 15 it not only moves away from the bottom 18 but rises in relation to the float 42. This change in relative positioning results in piston 34 traveling downwardly within the cylinder 32 permitting liquid to flow from the cylinder 24 to the cylinder 32 with the piston 26 being lowered with reference to the derrick 16 but actually being maintained at a constant height above the bottom of the well 20 thus maintaining constant position of the drill string 17.

FIG. 4 shows the trough of the wave 16 schematically represented with the vessel 10 at a lower level with reference to the bottom 18 of the body of water 12 and similarly the vessel 10 is lower with respect to the float 42 so that the piston 34 is forced upwardly in the cylinder 32 causing hydraulic fluid to flow from cylinder 32 into the cylinder 24 raising the piston 26 relative to the drilling rig 16 and the vessel 10 but actually maintaining the piston 26 at a constant distance from the bottom of the well 20 despite the motion of the vessel 10.

It is to be noted that although various adjustments have been described in preparing for the above described compensator action that there is no necessity for manual or automatic valving during normal operation of the apparatus of this invention for any succession of waves within the built-in capacity of the particular apparatus. Of course the above described response to wave action is continued repetitively as long as the waves and drilling continue.

It is further to be noted that change in the weight of the drill string can be accommodated by adjusting the amount of water within the float 42 under control of compressor 43 and the valve 46, but no adjustment of the amount of water within the float 42 will normally be necessary during drilling activity until drill pipe is added or subtracted at which time the increased or decreased weight of the drill string will necessitate adjustment of the amount of water in the float 42.

Since straight hydraulics with no mechanical lever elements are desirably being used from the hook at the bottom of the suspension 22 to the bottom of the well 20, the stroke of the piston 26 in the cylinder 24 must be at least equal to the vertical heave of the vessel in which it is desired to operate the apparatus of this invention. Under some conditions this might mean that the cylinder 24 was as much as 20 feet long. With such a cylinder length the height of the derrick may have to be increased for normal operation of adding to or subtracting lengths of pipe. While this is possible it is probably undesirable and for this reason applicant has invented a cylinder operating in the same manner for the same purpose as cylinder 24 but incorporated in the table apparatus normally used in supporting deep well drill strings and the like.

Figure 5:
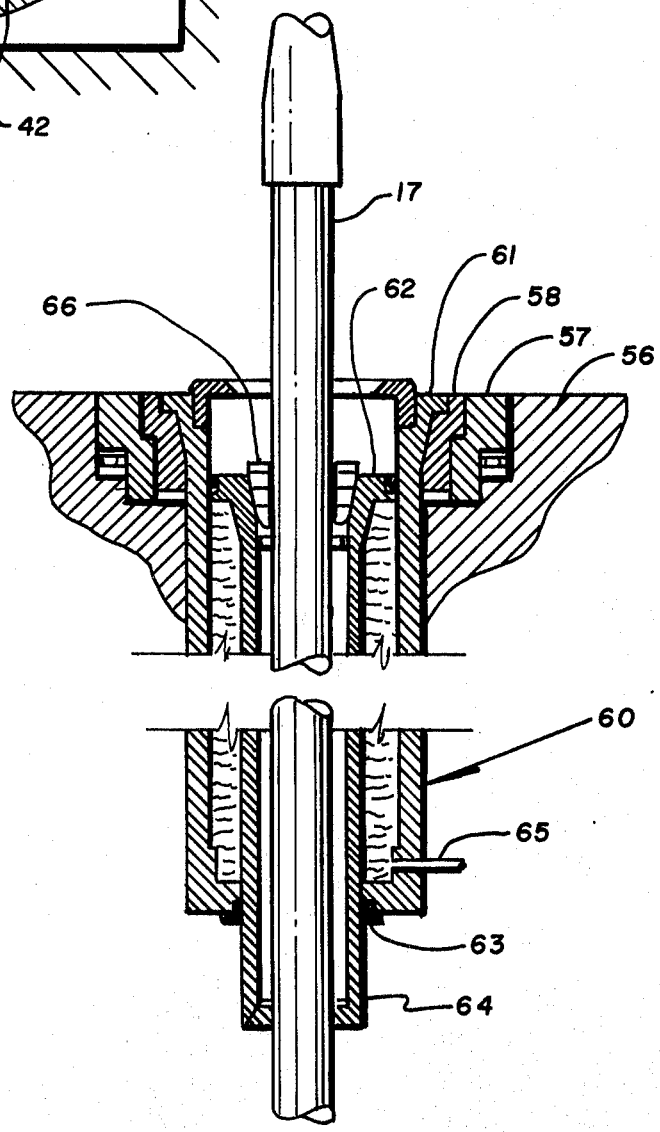
FIG. 5 is a fragmentary sectional view of a particular embodiment of a hydraulic support cylinder constructed according to the principles of this invention.

In FIG. 5 there is to be seen such an embodiment of the principles of this invention in a generally cylindrical axially elongated slip bowl extension cylinder generally indicated at 60 supported in a well known manner by a rotary table support frame 56 normally part of the derrick floor (not shown) upon which is rotatably mounted a rotary table 57 receiving and supporting a rotary table insert bowl 58 which similarly receives and supports the extension cylinder 61, of the combination 60, analagous to the hook type cylinder 24 in the first embodiment of this invention. A hollow piston 62 slidably and sealingly received within the cylinder 61 extends downwardly through the bottom of the cylinder 61 wherein suitable seals 63 slidably, sealingly engage the outer surface of an enlarged hollow piston rod 64 to provide hydraulic cylinder piston action in a well known manner. A fluid conducting line 65 analogous to line 28 of FIG. 1 is shown connected to the interior of the cylinder 61 to provide for supply and removal of hydraulic fluid by action of the float 42 on cylinder 32 (FIG. 1) as described for the first embodiment.

In FIG. 5 drill string 17 of the first embodiment is shown as extending downwardly through the hollow center of the piston 62 and supported therein in a well known manner by slips 66 engaged with an inwardly tapered portion of the hollow center of the piston 62 and biased into supporting engagement with the drill string 17 in a well known manner. Thus, as necessary the drill string 17 when disconnected from the hook support is supported by the piston 62 at constant height relative to the sea bottom.

Figure 6:
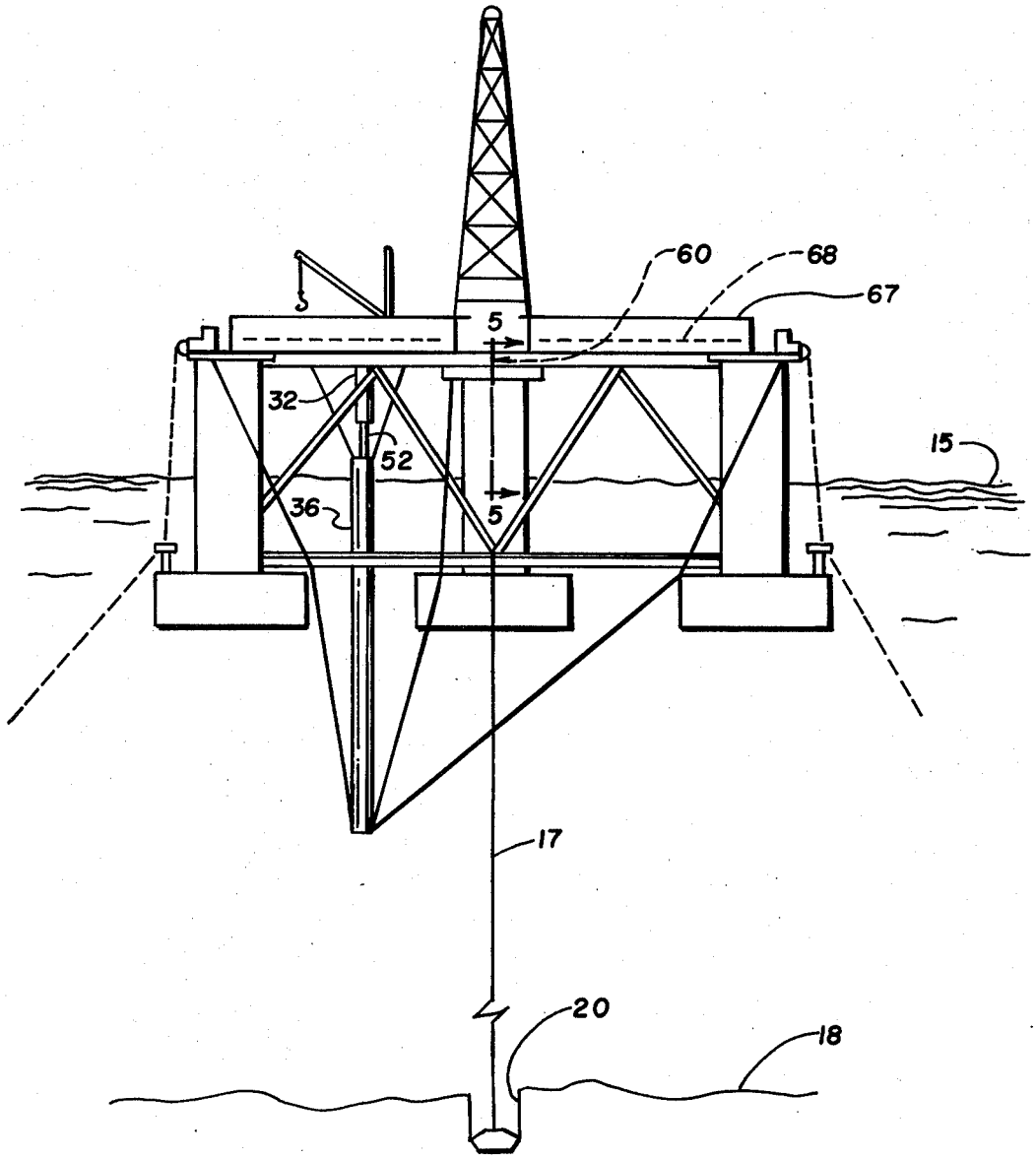
FIG. 6 is a schematic representation of a semi-submersible drilling platform with apparatus constructed according to the principles of this invention mounted thereon.

In FIG. 6 there is shown a semi-submersible drilling platform 67 of a well known design incorporating the just described slip bowl extension cylinder 60 in the drill string 17, at the location indicated by line 5—5 in FIG. 6, with the earlier described conduit 36 suitably supported and controlled by cables, with the piston rod 52 extending upwardly into the cylinder 32 in the same manner as earlier described with relation to FIGS. 1, 3 and 4 so that the cylinder 32 is available to furnish pressure fluid to the extension cylinder 61 and piston 62 (not shown in FIG. 6) but able to operate in the same manner as that described for the first embodiment.

Under certain circumstances it is desirable to use external power in the cylinder circuit to avoid having the conduit cylinder of the same configuration as the hook cylinder by using the conduit cylinder and piston as pilot apparatus to activate a pump in the proper direction dictated by the motion of the vessel to move the hook piston upwardly or downwardly as the case might be to counteract vessel motion.

Up to the present, calculations have indicated that a 200 foot conduit will be highly effective in sea states generated by a wind velocity up to approximately 25 knots and that the 300 foot length of conduit would be effective in sea states due to wind velocity above that figure, on the order of 30 knots.

If external power, activated as above described, is used to maintain constant pressure, a conduit 100 foot long may be made highly effective in maintaining constant drill string positioning. It has in fact been determined that a conduit 150 foot long with the refining effect of no more than 30 horsepower externally applied can smooth out the pressure variations of very rough sea states.

Figure 7:
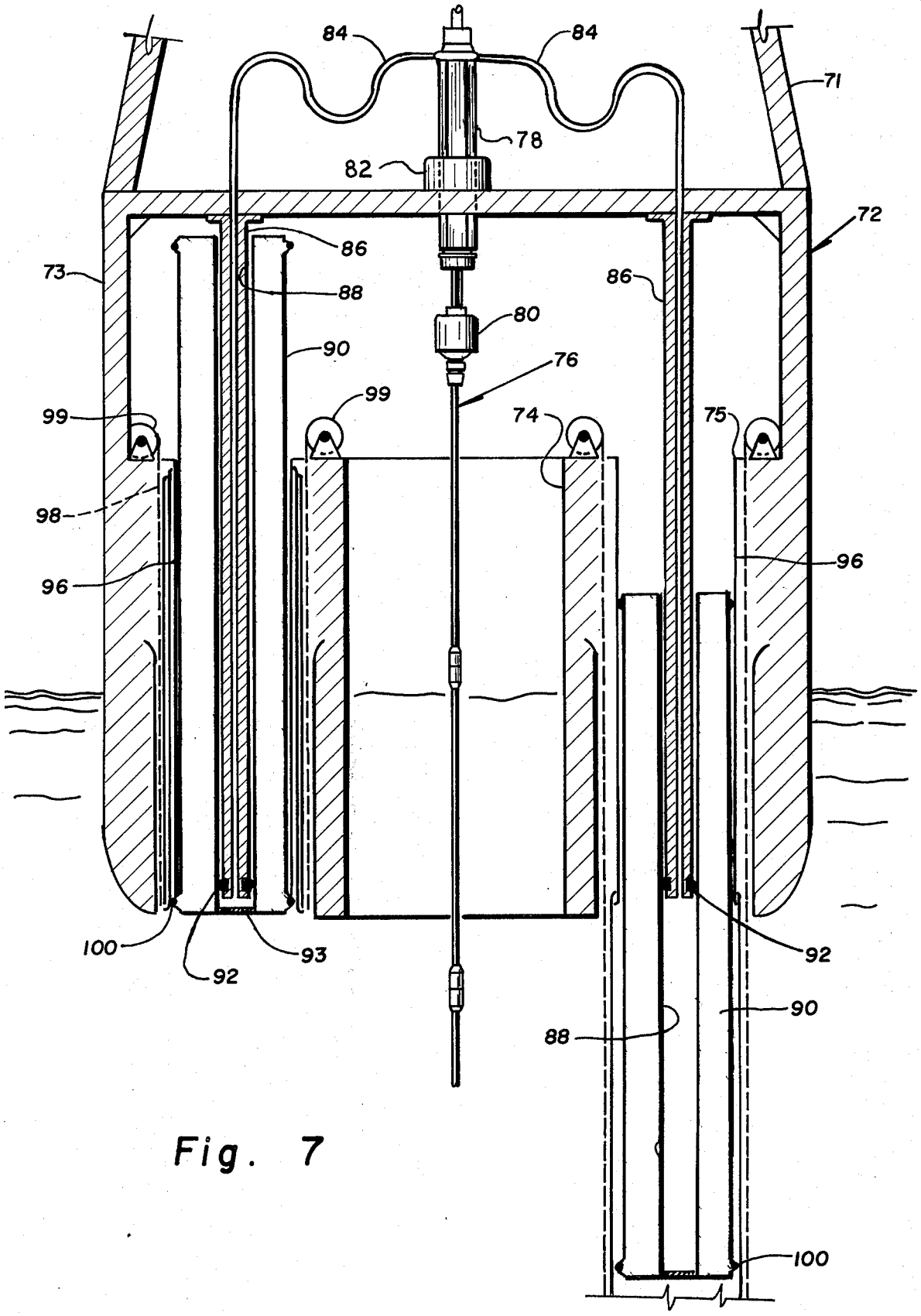
FIG. 7 is a schematic representation of a second embodiment of the counterbalancer of this invention incorporated in a drilling vessel floating on a body of water.

In FIG. 7 there is to be seen a schematic representation of the cross sectional view of a floating drilling vessel 72, of the ship-shape type, comprising another embodiment the principles of this invention and incorporating elements, not shown in the earlier embodiments, but usable therein in various combinations. As seen in FIG. 7 the vessel 72 has a centrally located opening 74 commonly referred to as a moon pool extending downwardly through the main portion of the vessel from a point well above the water line through the bottom of the ship. Extending downwardly through the opening is a drill string generally indicated at 76 incorporating an extensible kelly 78 and a flexible driving ball joint 80 immediately therebelow both of which will be more fully described at a later point in the specification. The kelly 78 is shown as an elongated member of non-circular, for example hexagonal, cross section drivingly mounted in a kelly bushing 82 in turn supported and driven by a rotary table 57 mounted in a table support frame 56 (see FIG. 12) in a well known manner. The length of the kelly hexagonal portion will of course be great enouth to feed off a full length of drill pipe which drill pipe will be added as necessary.

The kelly 78 of this embodiment is shown in FIG. 7 to be connected by a flexible hydraulic line 84 to the central bore of an elongated vertically extending tubular member such as a wash pipe 86 extending downwardly from and secured to a derrick support or sub-structure 73 mounted on the deck 75 of the vessel 72 and supporting a derrick 71 of a type well known in the art, only a fragment of which is shown at the top of FIG. 7. The left hand side of the FIG. 7 shows the wash pipe 86 extending downwardly through the blind central longitudinal opening 88 of an elongated, hollow cylindrical float 90 extending upwardly from approximately the bottom surface of the vessel 72 to a point downwardly adjacent the underside of the sub-structure 73 in the condition shown in the left hand portion of FIG. 7. Mounted near the bottom of the wash pipe 86, on its exterior surface, and sealingly engaged with the interior of the opening 88 in the float 90 is a sealing element 92 which transforms the wash pipe 86 into a piston cooperating with the opening 88 which being closed at the bottom as at 93 and filled with fluid up to wash pipe 86 now becomes a cylinder 88 to provide pressure fluid to be transmitted through the flexible hydraulic line 84 for a purpose hereinafter set forth.

Surrounding the float 90 and extending from main deck 75 through the bottom of the vessel 72 is a multiple section, telescopic, extensible conduit 96 having its innermost section supported by the main deck 75 and its extensible portions supported by flexible connections such as cables 98 controlled and activated by hoists 99 which pay out cable 98 for extending the conduit 96 or take up on the cable 98 to retract the conduit 96 as seen at the left in FIG. 7. Extending radially outward from both ends of the float 90 is a plurality of roller elements 100 or other guide means to contact the interior of the conduit 96 and provide for smooth-up and down motion of the float 90 within the conduit 96 as necessitated by the operation of the apparatus of this invention as the vessel heaves, pitches and rolls under influence of wave action in the water wherein the vessel 72 is floating.

At the right hand side of the kelly 78 an entirely similar set of elements is shown with the flexible hydraulic line 84 connected to the wash pipe 86 having seals 92 sealingly engaged with the interior of the opening 88 in a second float 90 so that the wash pipe 86 and the opening 88, closed at the bottom, again act as piston and cylinder respectively in the hydraulic system connected to the kelly 78. The right hand portion of FIG. 7 shows the operating condition of a second extensible conduit 96 in the extended condition only partially shown because the conduit may be 200 or 300 feet long as hereinbefore set forth. Again in the right hand portion of FIG. 7 the float 90 is shown in operating position, as it would normally be, midway through the period between a wave crest and a wave trough.

Figure 8:
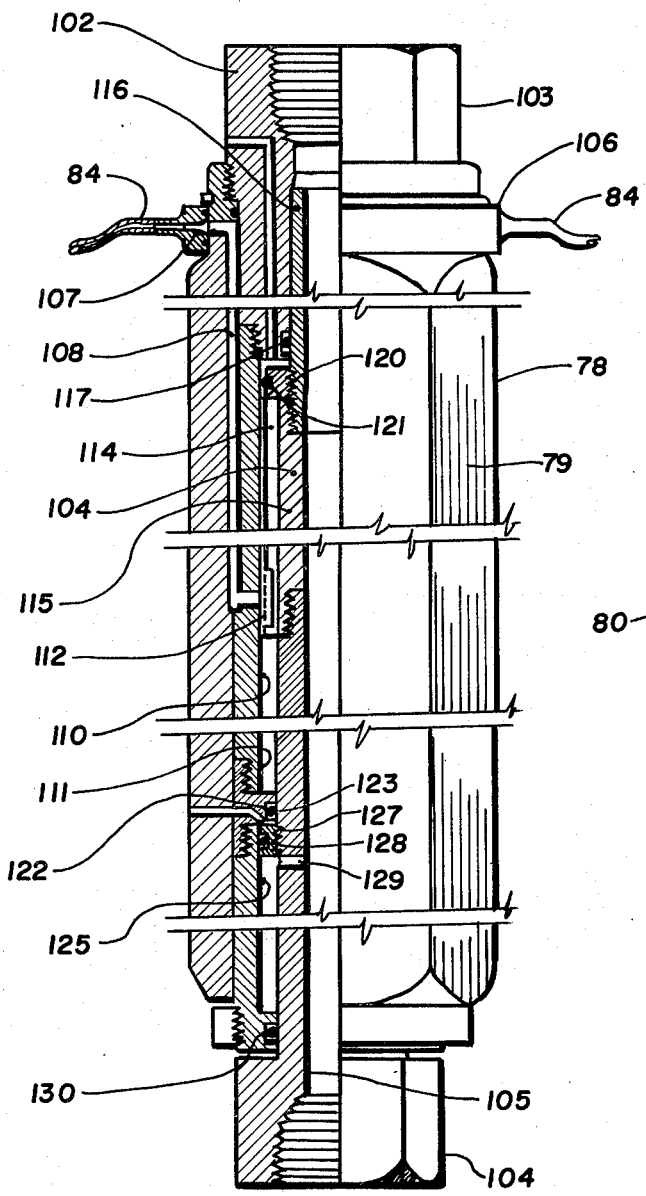
FIG. 8 is a partially sectioned fragmentary representation of a kelly portion of FIG. 7.
Figure 12:
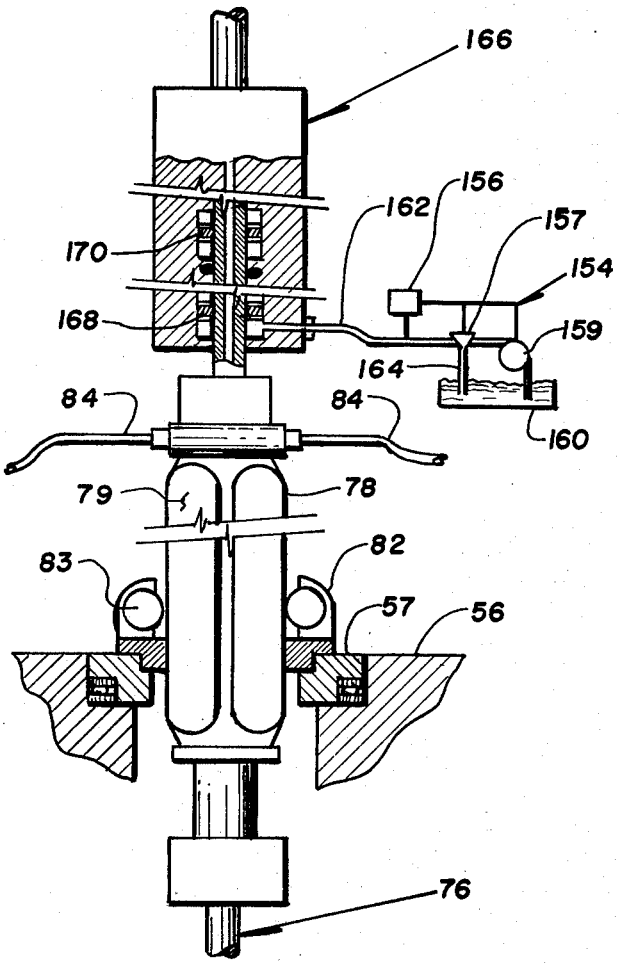
FIG. 12 is a schematic representation of an auxiliary power boost applied to the counterbalancer of this invention.

As best seen in the partially sectional view, FIG. 8, the kelly member 78 of this embodiment is a type of kelly incorporating the principles of this invention by taking over the function of the derrick cylinder 24 and piston 26 of FIGS. 1 through 4, with the kelly 78 comprising an elongated hollow body portion 102 having threads at its upper end adapted to be connected to a support element of a well drilling string in a well known manner. The interior of the body 102 slidingly receives a hollow mandrel element 104 extending upwardly through the bottom of the body 102 nearly to the threaded portion at the top of the body 102 with threads formed in the bottom end of the mandrel 104 for connection to a drill string. The exterior of the kelly 78 for a majority of its length is non-circular or fluted, as for example, hexagonal in cross section to provide a plurality of surfaces 79 for engagement by roller elements 83 of a kelly bushing 82 as seen in FIG. 12. Upwardly adjacent the flats 79 and below the box end 103 a rotating collar 106 is slidingly sealingly received on the outer surface of the mandrel 102 to provide stationary connections for the hydraulic lines 84 which communicate by way of passageways 107 within the rotating collar and a communicating passageway 108 formed in the body 102 in communication with an axial internal bore 110 of the body 102 to transfer pressure from the cylinder 88 (FIG. 7) by way of the wash pipe 86 and the hydraulic lines 84 to the interior of the kelly 78. In case a power swivel is being used the kelly could become a heave compensator with no power transmitting flat surfaces needed.

Within a central portion 111 of the bore 110 short spline elements 112 formed in the interior of the body 102 drivingly engage elongated spline elements 114 formed on the exterior of the mandrel 104 so that driving force applied to surfaces 79 through the kelly bushing 82 will be transmitted to the mandrel 104 for the purpose of providing the rotary motion for rotary drilling as is known.

The upper end portion of the mandrel 104 is a tubing element 116, slidably sealingly received within the smallest diameter portion of the bore 110 with a sealing element as at 117 keeping drilling fluid in the central bore 105 of the mandrel 104 from escaping into the bore portion 111 at this point. The tubing element 116 connects at its lower end with a larger diameter externally splined portion 115 of the mandrel 104 having at the upper end thereof a piston element 120 provided with a sealing element 121 slidably sealingly engaged with the interior of the bore portion 111. At the bottom of the central portion 111 of the bore 110 within which the piston 120 and the splines 114 are reciprocable is a removably secured, inwardly extending bushing element 122 having a sealing element 123 slidably sealingly engaging the exterior of the mandrel 104 so that this portion 111 of the bore 110 becomes a hydraulic cylinder within which the piston 120 desirably equal in area to piston 34 of FIG. 1, operates. Below the bushing 122 the lower end portion of the bore 110 forms a cylinder 125 slidably sealingly receiving a balance piston 127, mounted on mandrel 104, having a sealing element 128 slidably sealingly received within the bore portion 125. A plurality of mandrel ports 129 radially extending from the bore 105 into the bore portion 125 below the piston 127 provide communication between the interior of the mandrel 104 and the cylinder 125 formed by the lower portion of mandrel 104 slidingly sealingly engaging the bottom end of the body 102 as shown at 130.

The piston 127 in the cylinder 125 provides counterforce if desired to balance the tendency of drilling fluid pressure in the bore 105 to produce an elongation force on the mandrel 105 in the body 102. As set forth in my copending application Ser. No. 372,856 filed June 5, 1964 when the effective area of the piston 127 is equal to the effective end area of the end tubing portion 116 of mandrel 104 a balance between contracting and extension forces will be achieved. The above-mentioned "effective end area" of the mandrel body 104 is the entire area within the circle having a diameter equal to the outside diameter of tubing 116 since this is the effective area on which fluid pressure within the mandrel 104 and suspended drill string acts to force the mandrel 104 downwardly as viewed in FIG. 8.

Figure 9:
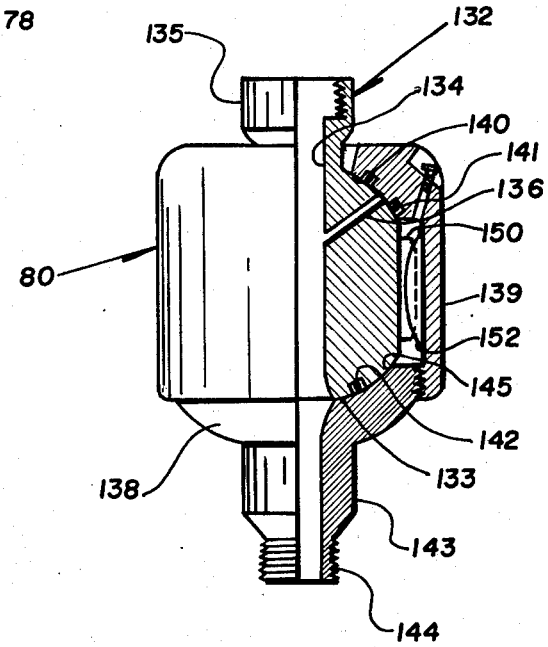
FIG. 9 is a partially sectioned view of a ball joint portion of FIG. 7.

As best seen in FIG. 9 the drill string ball joint 80 comprises a hollow, partially cylindrical, inner element or mandrel 132 having a threaded upper end 135, a bore 134 extending axially therethrough and external generally spherical surface portions 133 with a port 136 communicating between the bore 134 and the surface 133 for a purpose to be made plain.

The housing or body of the ball joint 80 is comprised of two elements, an upper shell portion 139 having a portion of a spherical internal surface 140 therein matable with the upper portion of surface 133 and a spaced pair of sealing elements 141 mounted in the surface 140 and sealingly engaging the upper portion of the surface 133 on either side of the port 136. The housing 138 also comprises a lower end portion 143 having threads 144 adapted to be engaged with the threaded end of a drill pipe and also provided with a spherical inner surface 145 sealingly matable with the lower portion of the spherical surface 133 enclosed by a seal 142 spaced from the bore 134, in sliding engagement therewith to provide for controlled flexibility of the mandrel 132 within the housing 138 as in common ball joints. The central portion of the spherical surface 133 of the mandrel 132 has been cut away to form a cylindrical surface from which radially extending splines 150 extend outwardly and engage internally extending splines 152 formed on the interior of the shell portion 139 to transmit rotational force for drilling. Only one of each spline has been shown but of course any number of splines 150 and an equal number of splines 152 mated together can be employed to provide the strength necessary for transmitting the required horse power used in drilling.

One feature of the ball joint 80 of this invention resides in the port 136 through which drilling fluid under pressure in the bore 134 will apply a force between surface 140 and the upper portion of the surface 133 to counteract the force on the pin end 143 due to the drilling fluid in the bore 134 tending to make the ball joint act as a hydraulic jack. With the pressure of the drilling fluid acting through the port 136 upwardly on the surface 140 and downwardly on the surface 133 the forces tending to extend the ball joint 80 in the manner of a hydraulic jack are counterbalanced and in case the effective area between the seals 141 is equal to the effective internal area of the pin end 143 out to the seal 142, the forces will be balanced and flexing action of the ball joint 80 will be the same under various internal fluid pressures as it will be with internal pressure equal to ambient pressure on the joint 80.

The maintenance of such flexibility eliminates harmful bending stresses which is an especially important consideration when drilling from a floating vessel subject to the wave action causing the vessel to pitch and roll in a manner well known to those engaged in underwater drilling from a floating vessel.

The operation of the embodiment of FIGS. 7 through 9 is the same as that earlier described for the embodiment of FIGS. 1 through 6 except for the action of the balanced and extensible kelly 78 which is hereinafter described.

With the vessel 72 (FIG. 7) on station and with drilling having been initiated, the conduits 96, normally evenly distributed on opposite sides of the centerline of the ship 72 or on centerline but capable of being operated as a single conduit, or in other configurations, will be extended downwardly the desired distance as perhaps 200 feet and allowed to fill with water to the common level of the body of water in which the vessel 72 is floating. The kelly supported from a hook and hoist arrangement (not shown) of any well known type in turn supported by the derrick 71 is engaged with the bushing 82 in a well known manner and the kelly 78 can slide downwardly through the bushing 82 as drilling progresses until such time as it is necessary to add a length of drill pipe at which time the derrick hoist will be used to raise the kelly and the drill string with the joint 80 thereon through the kelly bushing 82 after which it will be possible to insert another length of drill pipe and, after lowering the kelly and the drill string therewith through the bushing 82, to proceed with the drilling in a well-known manner.

While the drilling is progressing with waves causing vessel heave in the usual manner the amount of hydraulic fluid in the float cylinder circuit will be adjusted so that the floats 90 with the vessel on an even keel between trough and crest will be located approximately as shown at the right hand side of FIG. 7 with approximately the middle of the float 90 being engaged by the seals 92. The amount of air versus the amount of liquid within the float 90 will be adjusted by means not shown so that the total weight of the drill string will be just counterbalanced by the flotation effect of the floats 90 as described for the first embodiment.

With the above described conditions obtaining, the floats 90 (FIG. 7) will be maintained at a substantially constant distance from the bottom of the body of water and likewise from the bottom of the well being drilled so that when the vessel 72 moves upward on the crest of a wave the float 90 apparently moves downward with respect to the piston 92.

Such downward motion of the float 90 allows liquid from the chamber 111 (FIG. 8) to flow outwardly through passageways 108; 107 and the hydraulic lines 84 into the cylinders 88 (FIG. 7) to allow the piston 120 (FIG. 8) to drop downwardly within the bore 110 by an amount equal to the rise of the vessel 72 on the wave so that the support of the drill string remains at a constant distance from the bottom of the well and a constant tension is thereby maintained on the drill string. Such constant tension is signaled by a constant pressure in the float circuit making it possible to monitor the effectiveness of the float arrangement including the length of the conduits.

In the embodiment seen in FIG. 12 the support of drill string 76 by the piston 120 of the kelly 78 as above described connected to floats 90 is augmented by an auxiliary power supply generally indicated at 154 comprising a pressure sensing device 156, an adjustable relief valve 157 controlled by sensing device 156, a powered hydraulic pump 159 and a liquid filled reservoir or tank 160 all connected so that at a given pressure in the sensor 156 transmited from a line 162 connected to the outlet of the pump 159, the sensing device 156 operates the valve 157 to pass liquid from the pump 159 to the reservoir at a rate which will maintain a desired pressure in line 162. Whenever a greater amount of liquid is furnished by pump 159 or float cylinder/piston than is required to maintain the pressure in the line 162 such added liquid will be vented back to tank 160 through a line 164 connecting the outlet of the relief valve 157 to the tank 160. The liquid supply from the line 162 can be connected to line 84 or alternatively can be used in an auxiliary cylinder shown at 166 as supporting the drill string 76 through the kelly 78 by the use of a piston and cylinder arrangement schematically illustrated at 168 operating in the same manner as the piston 120 in the cylinder 111 as shown in FIG. 8. A second piston and cylinder arrangement 170 above the piston and cylinder 168 is connected to the interior drilling fluid conduit of the drill string and provides balanced operation as described for piston 127 in cylinder 125 of FIG. 8.

With the arrangement as shown in FIG. 12 the operation of the drill string 76 under the influence of the floats 90 in the conduits 96 can be polished by the operation of the constant pressure arrangement acting on the auxiliary cylinder 166 so that it is no longer necessary to assure complete removal of pressure variations from the hydraulic lines 84 and the chamber 111 since undesirable variations taking place therein can be overcome by the use of the auxiliary cylinder 166 as above described.

It is further to be noted that the power supply 154 can be connected directly to the balanced and extensible kelly 78 by way of lines 84 to directly polish the action of the floats 90 in the conduits 96 by the use of auxiliary power as above described.

Figure 13:
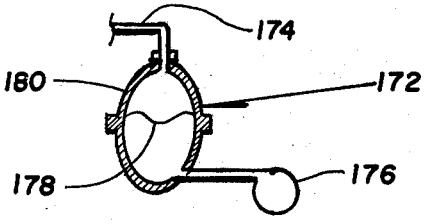
FIG. 13 is another embodiment of the auxiliary power boost to be applied to the counterbalancer of this invention.

FIG. 13 shows a schematic arrangement of another auxiliary supply generally indicated at 172 and connectable by a hydraulic line 174 to either the line 162 or the line 84 of FIG. 12 to provide polishing of the constant pressure maintenance by the use of a gas bottle 176 incorporating a constant pressure regulator and feeding into one chamber of a diaphragm 178 separated interior of a pneumatic-hydraulic accumulator 180 of a well known type so that the regulated pressure from the gas bottle 176 can be used to regulate the hydraulic pressure within the lines 172 or 84 with the same effect as that found in the action of the auxiliary power supply 154 above described.

Figure 10:
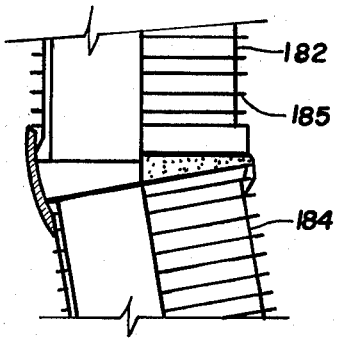
FIG. 10 is a partially sectioned fragmentary representation of a flexible conduit connection suitable for use in any of the embodiments of the present invention as shown in FIGS. 1, 3, 4, 6 and 7.
Figure 11:
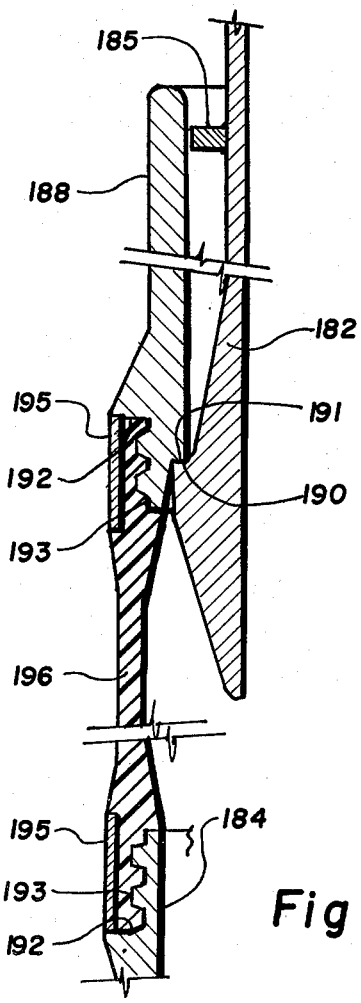
FIG. 11 is an enlarged fragmentary sectional view of a portion of the conduit of FIG. 10.

Since it is considered necessary to have large conduits of great length suspended from the bottom of the drilling vessel it is likely to be desirable to provide flexibility and strengthening for these conduits and such effects are available from the design shown in FIGS. 10 and 11.

In FIG. 10 there is seen the bottom end portion of an upper conduit section 182 and the upper end portion of a lower conduit section 184 each of which is provided with a plurality of stiffening rings 185 encircling the outer surfaces of the respective conduits for the purpose of strengthening such a conduit against Froude-Krylov forces tending to collapse such a conduit.

In FIG. 11 where the conduits are connected together there is shown a tapered and stepped portion of the conduit 182 upon which a steel collar 188 will rest, which collar extends all the way around the conduit 182 having been assembled thereon from the other end of the conduit 182 engaging an enlarged lower end portion of the conduit 182 by means of a shoulder 190 formed on the lower inner surface of the collar 188 abuttingly engaged with an upward facing shoulder 191 formed on the exterior of the lower end portion of conduit 182. The lower end portion of the collar 188 has an external downwardly facing shoulder 192 and a series of circumferential corrugations extending around the surface of a reduced diameter portion of the collar 188. The upper end of the lower conduit 184 is formed in quite similar manner with corrugations 193 extending thereabout on a reduced diameter portion forming a shoulder 192. Fitted into the corrugations 193 on both conduits and extending therebetween is a flexible ring member of rubber, or other suitable flexible material of requisite strength, cemented there and further fastened by a tight steel ring 195 to maintain the connection of conduit 182 and conduit 184.

With such connections through the rubber ring member 186 a limited amount of flexibility is introduced into the conduit between the various sections thereof with the advantage of enormously reducing the stresses in the conduit and forces on the vessel because of normal pitch and roll of the vessel.

It is to be realized that various combinations of the different details shown in the several embodiments are envisioned as being within the scope of this invention and further that the hydraulic components and forces above described may be partially or wholly replaced by gas pressure components and forces.

What is claimed is:

1. A method of maintaining a substantially constant positioning of a string of members suspended from a vessel floating on a body of water comprising the steps of; isolating a limited portion of said body of water within a downwardly extending elongated conduit carried by such a vessel in a manner that the upper level of said limited portion of said body of water remains at a substantially constant height above the bottom of said body of water regardless of substantially all wave action in said body of water, supporting float means in the upper reach of said limited portion at a substantially constant height with respect to said upper level of said limited portion of said body of water, applying flotation force from said float means to pressure fluid means supported by said vessel whereby said last mentioned means supports such a string of members suspended therefrom at substantially constant upper end height avove such a bottom.

2. A method as specified in claim 1 wherein said conduit extends downwardly into said body of water to a virtually stable water level to isolate said limited portion from substantially all wave action.

3. A fluid actuated counterbalancer for a string of members suspended from a vessel floating on a body of water comprising; pressure fluid means supported by said vessel and having an extensible portion supporting the upper end of such a string of members by force of pressure fluid therein, an elongated conduit supported by said vessel and extending downwardly into such a body of water to a virtually stable water level such that the upper level of the limited portion of such a body of water isolated within said conduit remains at a substantially constant height above the bottom of such body of water regardless of substantially all wave action in such body of water, the lower end portion of said conduit being in free communication with such a body of water, float means supported at substantially constant height by such a limited portion of such a body of water isolated within said conduit while said vessel moves up and down by wave action, said float means being cooperable with said pressure fluid means to apply flotation force to said pressure fluid to extend and retract said extensible portion in response to said wave action to maintain said upper end at substantially constant height above the bottom of the body of water.

4. A fluid actuated counterbalancer as specified in claim 3 wherein said pressure fluid means comprises first fluid actuated means supporting said string of members in pressure fluid communication with second fluid actuated means providing pressure on a common fluid supply of said first and second means, said pressure being developed in said second means by action of said float means.

5. A fluid actuated counterbalancer as specified in claim 4 wherein said first and second fluid actuated means each comprise piston and cylinder means of equal effective area and each of said float means activates a piston means of said second piston and cylinder means.

6. A fluid actuated counterbalancer as specified in claim 4 further comprising auxiliary means providing selected additive and subtractive amounts of fluid to said common fluid supply in response to pressure variation in said fluid supply.

7. A fluid actuated counterbalancer as specified in claim 4 wherein each of said float means comprises: an inner and outer cylinder with end pieces forming a float chamber therebetween; said inner cylinder being a cylinder member of said second fluid actuated means; and said second fluid actuating means including a hollow piston member extending slidably sealingly downward within said cylinder member from a portion of said vessel.

8. A fluid actuated counterbalancer as specified in claim 3 wherein said conduit comprises: a plurality of separate lengths of conduit tubing; and a plurality of flexible joining means joining respective adjacent pairs of said conduit tubing together in end to end relationship.

9. A fluid actuated counterbalancer as specified in claim 8 wherein each of said flexible joining means comprises: a continuous tubular band of flexible high strength material overlapping adjacent end portions of contiguous conduit lengths; and an external clamping metallic band inwardly adjacent each end of said tubular band to reinforce said tubular band.

10. A heave compensating slip bowl for supporting a string of members suspended from a floating vessel comprising; a generally cylindrical axially elongated hollow slip bowl body having a cylindrical axially extending opening therein, a hollow piston sealingly slidably received in said opening, said piston having a hollow piston rod portion extending axially through said opening in radially inwardly spaced relation to said opening and forming a fluid tight variable volume chamber therewith, means at least partially within an end portion of said piston for gripping one of such suspended members to support such a string, fluid conducting means communicating with said chamber and adapted to be connected to a source of pressure fluid and said source of pressure fluid comprising float means adapted to be supported by an isolated portion of the body of water upon which such a vessel is to be floated.

11. A vessel heave compensation kelly adapted to be driven by a kelly bushing and for supporting a suspended drill string therefrom comprising: an elongated hollow kelly body; an elongated hollow mandrel body slidably received within said kelly body and forming therewith at least one fluid chamber therebetween; passageway means in said kelly body for communicating a variable fluid pressure to said chamber, a piston means on one of said bodies and in said chamber in sealing and sliding engagement with the other of said bodies for producing relative longitudinal movement between said bodies in response to a change in fluid pressure within said chamber acting on said piston means; said mandrel body having an effective end area being acted upon in an axial direction by the fluid pressure existing within said hollow mandrel body; and other surface means on said mandrel body being acted upon by the fluid pressure within said mandrel body in a direction opposite said axial direction for balancing the axial forces on said mandrel body produced by the fluid pressure existing within said mandrel body.

12. A vessel heave compensation kelly as specified in claim 11 additionally comprising: an annular flange on one of said bodies and in sealing and sliding engagement with the other of said bodies forming another chamber between said bodies axially spaced from said first mentioned chamber; and wherein said other surface means comprises an annular surface of a second piston means; said second piston means being mounted on said mandrel body and in said another chamber in sealing and sliding engagement with said kelly body; and said annular surface being in fluid communication with the interior of said mandrel body.

13. A vessel heave compensation kelly as specified in claim 12 wherein the effective area of said second piston means is substantially equal to the effective end area of said mandrel body.

* * * * *